US005442831A

United States Patent [19]

Yamada

[11] Patent Number: 5,442,831

[45] Date of Patent: Aug. 22, 1995

[54] ANGULARLY ADJUSTABLE TOOTHBRUSH

[76] Inventor: Todd H. Yamada, 13900 Tahiti Way, #127, Marina Del Rey, Calif. 90292

[21] Appl. No.: 383,837

[22] Filed: Feb. 6, 1995

[51] Int. Cl.[6] ..... A46B 9/04

[52] U.S. Cl. ..... 15/167.1; 15/144.1; 15/172; 403/92

[58] Field of Search ..... 15/144.1, 167.1, 172; 403/92, 93, 95, 96

[56] References Cited

U.S. PATENT DOCUMENTS

| | | | |
|---|---|---|---|
| 165,236 | 7/1875 | Jenness | 403/93 |
| 612,491 | 10/1898 | Eck | 15/144.1 |
| 862,762 | 8/1907 | Schliesser | 403/93 |
| 919,610 | 4/1909 | Maeder | 15/144.1 |
| 1,041,416 | 10/1912 | Bilbro | 403/93 |
| 1,092,014 | 3/1914 | Briggs | 403/93 |
| 1,389,249 | 8/1921 | Kitchel | 15/144.1 |
| 2,002,320 | 5/1935 | Jones | 15/172 |
| 2,032,664 | 3/1936 | Raptis | 15/172 |
| 2,091,716 | 8/1937 | Petta | 15/144.1 |
| 3,868,742 | 3/1975 | Brenner | 15/144.1 |

FOREIGN PATENT DOCUMENTS

| | | | |
|---|---|---|---|
| 134759 | 9/1933 | Austria | 15/172 |
| 214298 | 3/1961 | Austria | 15/144.1 |
| 1032247 | 3/1953 | France | 15/144.1 |
| 1075819 | 4/1954 | France | 15/172 |
| 2450579 | 11/1980 | France | 15/172 |
| 191745 | 8/1923 | United Kingdom | 15/172 |

*Primary Examiner*—Mark Spisich
*Attorney, Agent, or Firm*—Beehler & Pavitt

[57] ABSTRACT

An angularly adjustable toothbrush comprised of an elongated handle section and an elongated forward section with a brush array at its forward end. The after end of the forward section is provided with a transverse cylindrically rounded member with an axial orifice and flanked by a pair of concave shoulders facing rearwardly. A series of recesses spaced from each other is provided to circle part of the cylindrically rounded member. The handle section is bifurcated at its forward end to provide arms which embrace the cylindrically rounded member and are orificed in register with the member orifice to receive an axle pin to hold them together for rotation. The handle section has an axial bore extending from the bifurcation into the middle section of the handle and into which is disposed a slideable plunger biased forwardly by a spring toward the bifurcation so as to enter one of the recesses to lock the forward and handle sections in a particular angular configuration. The handle section is slotted into the bore to enable a central element to be secured to the plunger so that the plunger may be moved out of its biased position thereby enabling the angle of the forward section to be changed relative to the handle section.

6 Claims, 1 Drawing Sheet

ANGULARLY ADJUSTABLE TOOTHBRUSH

FIELD OF THE INVENTION

This invention relates generally to the field of brushes, and particularly to toothbrushes utilized for dental hygiene purposes.

BACKGROUND OF THE INVENTION

Toothbrushes in some form or another have been utilized probably since prior to the beginning of recorded history. Such brushes normally include a handle, to one end of which is affixed an array of bristles. Generally, the handle is rectilinear and stiff enough to support its bristle end. However, at least as early as 1890 a toothbrush was devised in which the bristle array could be moved angularly with respect to the handle, as shown in U.S. Pat. No. 430,909 to T. G. Wonderly. In subsequent years, a number of other patents have issued illustrating different ways in which the brush array of a toothbrush may be moved from an axial alignment with the handle portion of the toothbrush to some angular orientation therewith. Examples of various expedients to accomplish such angulation are found in U.S. Pat. No. 3,868,742, U.S. Pat. No. 4,796,225, U.S. Pat. No. 5,033,154 and U.S. Pat. No. 5,003,658.

A problem with prior art toothbrushes has been the difficulty from the standpoint of the user in making a change in the angle of the portion holding the toothbrush array with respect to the remaining handle portion of the toothbrush. In some cases, the change is effected by threading or rethreading connecting elements. In other situations, when the array is angled, the toothbrush becomes unstable. In still other cases, the mechanisms are elaborate and too expensive to fabricate. It is also essential that the components of the toothbrush be easily disassemblable so that they may be autoclaved or otherwise thoroughly cleaned. This requirement does not appear to have been fulfilled by prior art toothbrushes. What is needed, therefore, is a toothbrush of solid stable construction in which the angle of the array may easily be varied with respect to the axis of the handle member, and may be readily disassembled for the purpose above stated.

SUMMARY OF THE INVENTION

The present invention provides an easy angulatable bristle array by having a forward section with a bristle array and handle section. The forward end of the handle section is pivotally connected to the after end of the forward section by means of bifurcated arms within which is disposed a cylindrically rounded end of the forward section The latter end is axially orificed and a pin-like element is passed through orifices through the arms and the axial orifice in the cylindrically rounded member. The latter, which abuts the forward end of the handle where the bifurcation commences, is further provided with a plurality of recesses extending radially inwardly toward the axis of the cylindrically rounded member and spaced angularly from each other about the rounded member. The handle section is axially bored for a predetermined distance from its bifurcated end to receive a reciprocatable plunger, the after end of which is in contact with a spring which biases the plunger axially to seat its forward end in one of the angularly spaced recesses in the outer wall of the cylindrically rounded member at the after end of the forward section. Movement of the plunger out of a recess and against the biasing of the spring is accomplished by a control member which may move in an axial direction in a slot which extends between the axial orifice and the outer wall of the handle member. The control member is attached to the reciprocatable plunger so that when the control member is moved axially toward the after end of the handle, the plunger is withdrawn from one of the angularly spaced recesses in the rounded cylindrical member. Thereby the latter member may be rotated within the arms of the handle section to a preselected different angular orientation with respect to the axis of the handle member, in which orientation the forward handle section may be fixed by releasing the control member to permit the plunger to be pushed back by the spring into the nearest one of the recesses in the rounded cylindrical member.

These recesses are preferably disposed in the cylindrically rounded member so that the forward section may be initially axially aligned with the handle section, but may be disposed in a first setting at a 15–25 degree angle with respect to the handle section to enable the user to brush his or her teeth at the sides of the mouth. A second setting could be at a 25–35 degree angle to further facilitate brushing the user's bicuspids, and a third setting, at approximately 45 degrees, better to reach he user's molars. Markings could be provided on the upper face of the after end of the forward section to indicate at what angle the forward section has been set with respect to the handle section.

The toothbrush of the present invention may be easily and completely disassembled for cleaning and/or autoclaving its several parts by simply removing the pin or axle which extends through the bifurcated arms and the rounded cylindrical member of the after end of the forward section of the brush.

DESCRIPTION OF THE DRAWINGS

In the accompanying drawings.

DESCRIPTION OF THE PREFERRED EMBODIMENT

Figures 1, 2, 3:
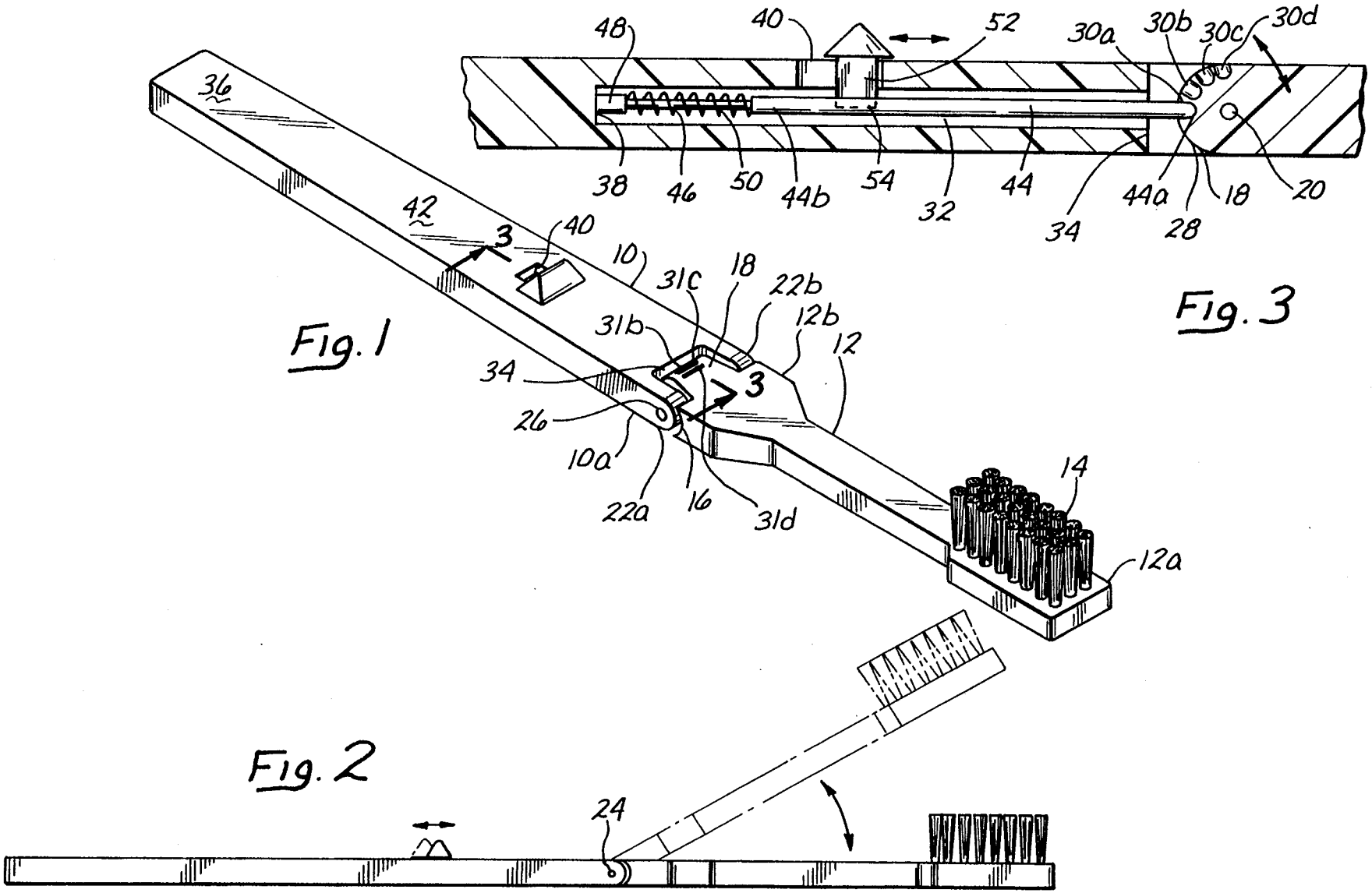
FIG. 1 is a perspective view of the toothbrush of the present invention.
FIG. 2 is a side elevation showing in phantom the manner in which the forward bristle array section may be angled relative to the handle section.
FIG. 3 is an enlarged section taken on the lines 3—3 of FIG. 1 looking in the direction of the arrows.

Referring to FIG. 1 of the drawings, the toothbrush of the present invention is formed of a handle section 10 and a forward section 12, on one end **12*a* of which latter section is mounted a brush array 14. The opposite end 12*b* of the forward section 12 is expanded to provide a pair of rounded shoulders 16 between which extends a cylindrically rounded member 18. The member 18 is transversely orificed at 20** in the axis of the cylindrical rounding.

The handle section 10 has its end **10*a* bifurcated to provide two arms 22*a* and 22*b* spaced apart from each other, the ends of which desirably are rounded to seat for rotation within the rounded shoulders 16 of the forward section 12. Each arm 22*a* and 22*b* is orificed at 24 in register with the orifice 20 in the cylindrically rounded end 18 of the forward section 12, to receive a pin 26 which is passed through both orifices 24 in the arms 22*a* and 22*b* and the orifice 20 in the cylindrical rounded end 28. The rounded wall 28 of the latter desirably is provided with several orifices 30***a*, 30*b*, 30*c* and 30*d*, each of which extends radially for a short distance toward the axis of the cylindrically rounded end 18 of the forward section 12.

The orifice 30*a* is disposed in the axis of the handle section 10 and the forward section 12 when the two sections are co-aligned. Orifice 30*b* may be 15 degrees from orifice 30*a*; orifice 30*c*, 25 degrees from orifice 30*a*; and orifice 30*d*, 45 degrees from orifice 30*a*, measured about the rounded wall 28 in a plane normal to the axis of the wall curvature. These angles may be somewhat varied, however, depending upon what may be most desirable to enable the brush array 14 to reach different area's of the user's mouth. Markers 31*a*, 31*b*, and 31*c* may be provided on the upper face of the rounded member 18 to indicate at which angle the forward section 12 is being disposed relative to the handle section 10.

The forward end 22 of the handle section 10 has an axial bore at 32 commencing at the wall 34 which extends between the arms 22*a* and 22*b*. The bore 32 extends axially as far as half the distance of the handle section 10 towards it butt end 36 where the bore 32 terminates at a transverse wall 38. A slot 40 is cut or molded in the upper face of the handle section 10 which slot 40 extends radially inwardly to the bore 32.

To effect a locking of the forward section 12 in any one of the three angular positions attainable by the forward section 12 with respect to the ends of the handle section 10, a plunger 44 is provided. The plunger desirably has a rounded end 44*a* and a hollowed opposite end 44*b* which may be fitted over a projecting shaft 46 seated in a base block 48 in contact with the wall 38. A spring 50 is provided on the shaft 46 to bias the plunger 44 toward and out of the wall 34 of the end 22 of the handle member 10. When so biased, the rounded end 44*a* will seat in one of the four recesses 30*a*, 30*b*, 30*c*, or 30*d* in the cylindrically rounded member 18 of the forward brush section 12.

In order to be able to move the plunger 44 against the bias of the spring 50 a control element 52 may be threadedly attached at 54 to the plunger 44.

In use, then, it may be seen that the toothbrush of the present invention may ordinarily have its handle section 10 and its forward section 12 in axial alignment. Such alignment is accomplished by having the plunger 44 inserted into the recess 30*a* in the cylindrically rounded member 18 of the forward section 12.

However, should it be desired to change the angle of the forward section 12 with respect to the handle section 10, the control member 52 is pushed in the slot toward the butt end 36 of the handle 10. This effects a withdrawal of the rounded end 44*a* of the plunger 44 from the recess 30*a*, thereby permitting the cylindrically rounded member 18 and its rounded shoulders 16 to rotate relative to the end 22 of the handle section 10. Such rotation may be terminated by releasing the control member 52, thereby enabling the plunger 44 to enter and seat in one of the other recesses 30*b*, 30*c* or 30*d*. When such entry occurs, the forward section 12 will be locked into the angular position, such as is shown in phantom in FIG. 2.

The toothbrush of the present invention and all of its parts may be cleaned by removing the pin 26 from the orifice 20, thereby detaching the forward section 12 from the handle section 10. By unscrewing the control member 52 from the plunger 44, the latter, together with the shaft 46, spring 50 and base block 48 of the shaft 46 may be shaken out of the bore 32. After cleaning, all of the parts may be easily reassembled, and when the pin 26 is replaced in the orifice 20 and orifices 24, the toothbrush will be found to be back in condition to perform its intended functions at whichever of the three angles may be desired by the user.

I claim:

1. An adjustable toothbrush, said toothbrush comprising:

a forward elongated section and an elongated handle section, each section having an axis adapted for coaxial alignment with the axis of the other section; each said section having a first end and a second end;

the first end of the forward section being provided with a bristle array extending normally from an upper side of the forward section; the second end of the forward section terminating in a cylindrically rounded member having an outer wall, the axis of which is transverse to the axis of the forward section, and said member being of a predetermined thickness defined by parallel spaced apart coaxial faces, and flanked by a pair of concave shoulders with their axis of concavity being parallel to the axis of the said member, said member further having an axial orifice and a series of spaced apart aligned recesses extending inwardly from the outer wall of the member, one of said recesses being disposed in the axis of the forward section;

the first end of the handle section being bifurcated to provide a pair of arms spaced from each other by a transverse wall extending a distance slightly more than the predetermined thickness of said cylindrical rounded member, thereby to enable said arms to embrace said member, and each of said arms having an orifice extending transversely of the axis of the handle member and alignable in register with the orifice in the cylindrically rounded member; and an axle inserted in the aligned orifices and extending from outer faces of the arms through the orifice in the said member;

said handle section further having an axial bore extending from the wall between the arms of the handle section for a predetermined distance toward the second end of the handle section, a portion of the first end of the handle section which defines said axial bore being slotted for a second predetermined axial distance between the bore and an outer wall of the handle section;

an elongated plunger, said plunger having a forward end and an after end and adapted to slide reciprocally in the bore between a first position in which the forward end of the plunger is extended into one of the recesses in the cylindrically rounded member, and a second position in which the forward end of the plunger is withdrawn from a recess in the cylindrically rounded member; and spring means extending between the after end of said plunger to an inner end of the bore, said spring means serving to bias said reciprocatable plunger into one of the recesses in the cylindrical rounded member of the forward section; and a control member extending radially from and secured to a side of the plunger through the slotting and beyond the outer wall of the handle section to enable the fingers of a toothbrush user to move the control member rearward in the slotting to cause the plunger to move from its first position to its second position in which latter position the forward section of the brush may be pivoted about an axis of the axle to change the orientation of the axis of the forward section with respect to the axis of the handle section to be fixed in a preselected orientation upon the release of the control member, whereby the plunger will be forced by the spring means into a respective one of the recesses in the cylindrical rounded member of the forward section to lock the forward section at the angle with respect to the handle section determined by the recess into which the forward end of the plunger is inserted.

2. The adjustable toothbrush as described in claim 1 wherein the forward section and the handle section are both substantially rectangular in cross section, and the slotting and control member on the handle section are disposed on a top side of the handle section.

3. The adjustable toothbrush as described in claim 1 wherein the forward section and the handle section are both substantially rectangular in cross section, and the cylindrical member extends between sides of the forward section, and between two sides of the bifurcated end of the handle section.

4. The adjustable toothbrush as described in claim 1 wherein forward ends of the arms of the handle section are rounded to mate for rotation with the concave shoulders flanking the cylindrically rounded member.

5. The adjustable toothbrush as described in claim 1 wherein the after end of the plunger is hollow to receive a shaft extending from the inner end of the bore in the handle section and said spring means is a helical spring provided to encircle the shaft and press against the hollow end of the plunger.

6. The adjustable toothbrush as described in claim 1 wherein markers are provided on the second end of the forward section to indicate the angular disposition of the forward section relative to the handle section.

* * * * *